United States Patent [19]

Sheets et al.

[11] 4,284,402

[45] Aug. 18, 1981

[54] FLAME MODIFIER TO REDUCE $NO_x$ EMISSIONS

[75] Inventors: Jesse E. Sheets, Griffith, Ind.; Bernard C. Vitchus, Palos Hills, Ill.; Tai S. Chao, Homewood, Ill.; Martin F. Zygowicz, Lansing, Ill.

[73] Assignee: Atlantic Richfield Company, Philadelphia, Pa.

[21] Appl. No.: 35,200

[22] Filed: May 2, 1979

[51] Int. Cl.[3] ..... F23M 3/12; F23C 9/02

[52] U.S. Cl. ..... 431/9; 431/8; 431/171; 431/347

[58] Field of Search ..... 431/8, 9, 3, 115, 116, 431/177, 186, 169, 171, 265, 347, 350, 168; 110/204, 211

[56] References Cited

U.S. PATENT DOCUMENTS

| | | | |
|---|---|---|---|
| 1,700,353 | 1/1929 | Evans | 431/171 |
| 3,238,994 | 3/1966 | Kirk | 431/347 |
| 3,251,393 | 5/1966 | Beach | 431/171 |
| 3,885,903 | 5/1975 | LaHage | 431/8 |

FOREIGN PATENT DOCUMENTS

| | | | |
|---|---|---|---|
| 960571 | 3/1957 | Fed. Rep. of Germany | 431/347 |
| 361648 | 11/1931 | United Kingdom | 431/350 |

*Primary Examiner*—George E. Lowrance
*Attorney, Agent, or Firm*—Stanley M. Welsh

[57] ABSTRACT

A method and apparatus for modifying the flow pattern of post ignition combustion products of a flame, preferably an oil fueled and air sustained flame, are disclosed which substantially reduces the concentration of $NO_x$ emissions.

10 Claims, 13 Drawing Figures

Fig. 1.
(PRIOR ART)
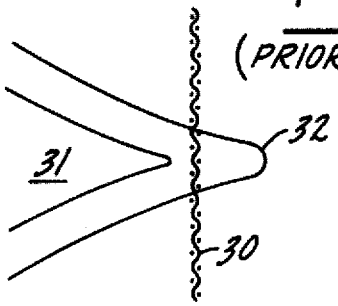
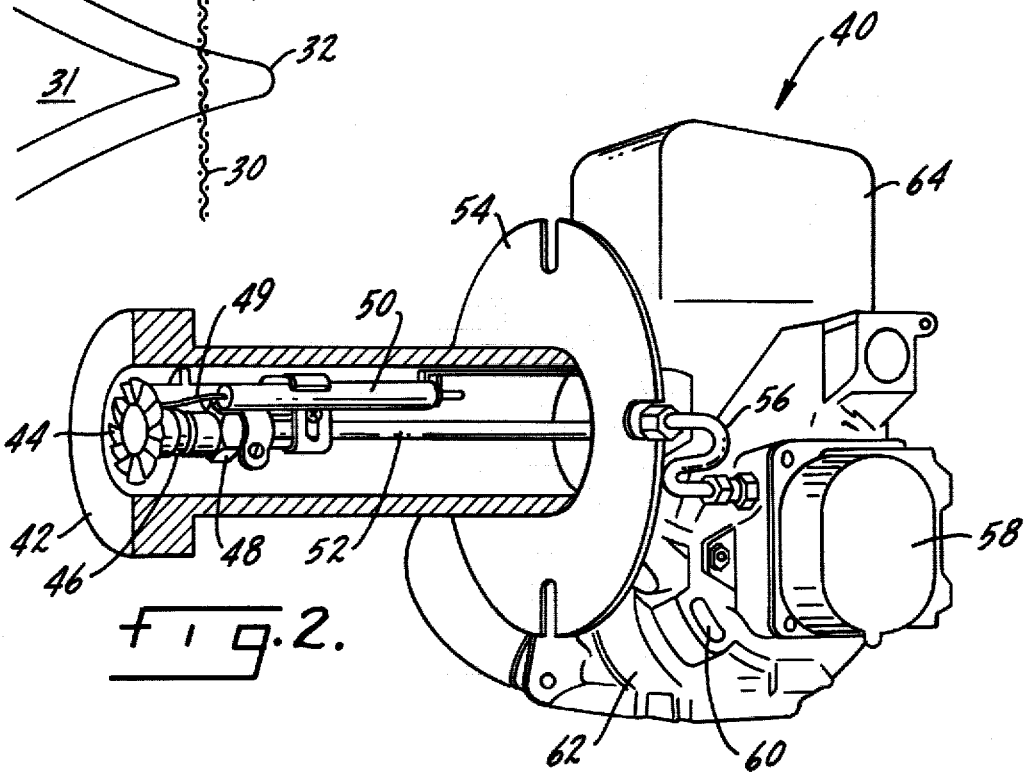
Fig. 2.
Fig. 3.
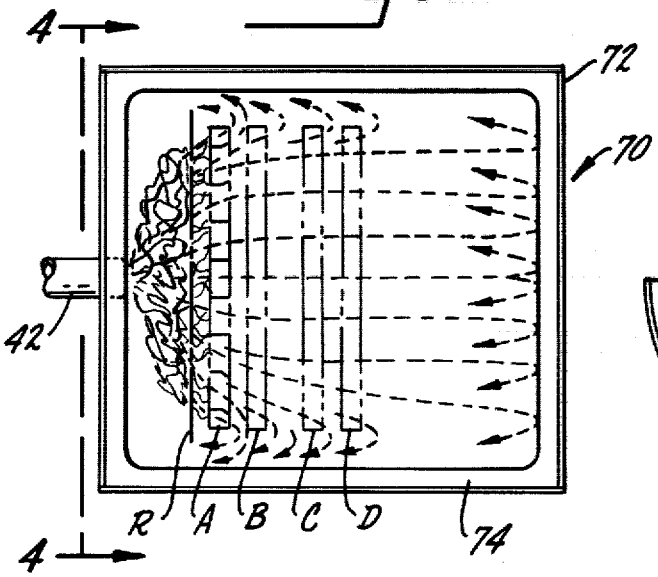
Fig. 4.
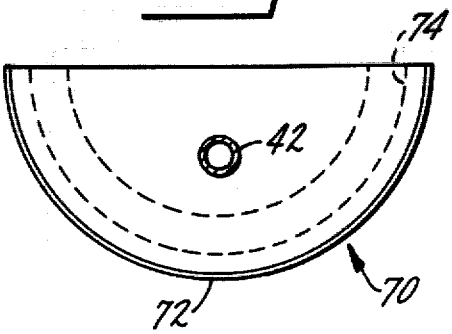

FLAME MODIFIER TO REDUCE $NO_x$ EMISSIONS

BACKGROUND OF THE INVENTION

Field of the Invention

The field of this invention relates to methods and apparatus for emission control of air sustained flames. More particularly, this invention relates to the $NO_x$ emission control of oil or gas flames by means of flame modification.

PRIOR ART $NO_x$ throughout this specification and claims comprises oxides of nitrogen, e.g. NO, $NO_2$, and the like, produced during combustion. $NO_x$ is an environmentally undesirable pollutant to the air.

One device to reduce $NO_x$ emissions of gas flames involves heat removal, i.e. a device for conducting heat away from a flame consisting of post ignition combustion products. Such devices are referred to as radiant screens. A wire mesh is inserted into a non-forced air gas flame preferably just above the cone of unburned gas, the flame hot spot, so as to be in as much of the flame as possible while still keeping the flame temperature high enough to provide complete combustion. This position is shown in FIG. 1.

The use of radiant screens in forced air burners is not practical because the flame temperature of forced air burners is generally too high and the oxidation atmosphere too severe. Another method used to reduce $NO_x$ emissions from a flame are secondary baffles which are designed to modify the ingress of air into the flames so as to control, and preferably decrease, the amount of oxygen available. Such secondary baffles do not directly interact with the flow of post ignition combustion products themselves.

Another way of controlling $NO_x$ emissions is to modify the fuel used, e.g. reducing the amount of nitrogen compounds, sometimes referred to as organic nitrogen, in the fuel. This tends to reduce the concentration of $NO_x$ produced.

There are at least two difficulties in using a radiant screen or secondary baffles with oil burning furnaces. One difficulty is that oil burning furnaces employing blast tubes and firing Number 2, Number 5, or Number 6 fuel, as defined according to ASTM D-396, have flames of very high temperature, for example, reaching temperatures as high as about 3500° F. The other difficulty is that secondary baffles must be independently designed to match the configuration of both the burner itself and the firebox or environment within which the flame of the burner is located.

It is an object of this invention to provide a means for reducing $NO_x$ emissions in flames having temperatures in the range of about 1700° F. to about 3500° F. It is an object of this invention to provide a means and device which is both adaptable to a variety of oil burner blast tubes and capable of reducing $NO_x$ emissions, without requiring any adjustment or modification to either the firebox or the burner, e.g. an oil burner, itself.

Other objects of this invention are clear to one of skill in the art based upon this specification.

BRIEF DESCRIPTION OF THE INVENTION

Broadly, the objects of this invention can be achieved by a method and apparatus for reducing $NO_x$ emission in a flame which comprises a method and means for reducing the amount of turbulence in that flame by imposing at least in part a non-turbulent flow pattern on post ignition or post emission combustion products of that flame. The temperature of the flame does not necessarily have to be lowered as a result of employing the method and apparatus of this invention in order to achieve the benefits provided by this invention. This invention is particularly useful with flames having temperatures above about 1700° F., and specifically, with flames having a temperature in the range of about 1700° F. to about 3500° F.

The percentage decrease in $NO_x$ emissions, with all other factors being kept constant, was found to depend upon the amount of reduction in turbulence of the post ignition products of a flame. A turbulent flow of a fluid, in the claims and throughout this specification means a flow in which the velocity gradient at any given point in the fluid changes randomly in magnitude and/or direction. The degree of turbulence prior to ignition that is at least sufficient to ensure adequate mixing between fuel and air for satisfactory combustion is well understood by one of skill in the art. Inadequate mixing will cause the flame to be smoky. Two conditions are essential for efficient fires as far as air delivery is concerned; these are (1) as little excess air as possible, and (2) sufficient turbulence. The greater the turbulence obtained, the less excess air will be needed, for the air that escapes the mixing process will be held to a minimum.

This is to be contrasted with laminar flow of a normal gas jet-type flame produced in a jet-type burner, such as can be found in a typical gas oven, gas water heater or gas furnace. Laminar flow is substantially non-turbulent.

More narrowly, the method and apparatus of this invention involves a method and means for reducing the amount of turbulence in the flow pattern of substantially only post ignition combustion products by imposing at least in part a laminar flow pattern thereon. An example of a particularly useful apparatus of this invention for inducing a laminar flow on at least a portion of the post ignition products of a flame by insertion therein is an array of vanes having passageways there between.

The vane material to be located in a flame must be stable both chemically and physically to the high temperature and oxidizing environment present in the flame. In addition to high temperatures, the material must be physically stable, e.g. does not crack in the presence of sudden and severe temperature changes within a firebox corresponding to on-and-off phases of a blast tube. Examples of materials which can withstand the environment in a typical oil burner firebox are: hastelloy alloys sold by Cabot Corporation, Indiana, nickel/chromium alloys, tungsten alloys, niobium alloys, tantalum alloys, ceramic materials such as silicon carbide, magnesia, beryllium, cordierite, and refractory oxides capable of withstanding high temperatures in the range of about 1700° F. to about 3500° F.

In summary, the objects of this invention for reducing $NO_x$ emissions in a flame having a temperature above about 1700° F. can be achieved by an apparatus to be located in the post ignition products of the flame, wherein the apparatus comprises a means for causing at least a portion of the post ignition combustion products of the flame to flow in a non-turbulent pattern. Preferably, the temperature of the flame is not significantly lowered as a result of employing the apparatus. This invention is particularly useful with turbulent flames having temperatures about 1700° F. and, specifically, with flames having a temperature in the range of about 1700° F. to about 3500° F. Forced air sustained flames employing fuels such as Numbers 2, 5 or 6 have been found to work particularly well with the method and apparatus of this invention.

More narrowly, the apparatus of this invention comprises a means for inducing a laminar flow pattern in at least a portion, e.g. at least about five percent, of the post ignition or post emission combustion products of a flame. Apparatus of this invention to cause a laminar flow pattern in at least a portion of a flame comprises an array of spaced vanes capable of withstanding the environment of that flame and having a plurality of passageways there between, wherein there is at least a first portion of the vanes which is substantially planar, and wherein there is a second portion of the vanes which is shaped so as to cause a curved flow path upon post ignition products of the flame which comes in contact therewith.

In more detail, the width, thickness and spacings between vanes whether planar or curved can be important in controlling the amount of reduction of $NO_x$ emissions. The uniformness of the spacings is generally not critical. It has been found that if the spacing between vanes is too large, all other factors being equal, then a significant reduction, e.g., about five percent, in $NO_x$ emissions is not observed. Also, it has been found that the spacings must be sufficiently large to avoid smoking or totally destroying the flow pattern of the flame in a firebox. Spacings or the closest distances between vanes preferably are in the range of about 3/16 of an inch to about 1 inch and more preferably in the range of about $\frac{1}{4}$ of an inch to about $\frac{3}{4}$ of an inch.

It has been found that if the width of the vanes is too narrow, all other factors being equal, then a significant reduction, e.g. about five percent, in $NO_x$ emissions is not observed.

Preferably the width of the vanes is in the range of about $\frac{1}{4}$ of an inch to about 2 inches. The width can be greater than 2 inches without adversely affecting the observed reduction in $NO_x$ emissions. For example, substantially no difference in the amount of reduction in $NO_x$ emissions was observed for a $1\frac{1}{2}$ inch wide vane as compared to a 3 inch wide vane, all other factors being equal. Thickness has been found to effect to a small degree the location of the smoke plane. The thickness of the vanes is preferably in the range of about 1/16 of an inch to about $\frac{1}{2}$ of an inch.

It has been found that by recycling at least a portion of the post ignition products of a flame which has been caused to flow in a non-turbulent pattern back into a portion of the flame which is in a turbulent flow pattern that there is a reduction in $NO_x$ emissions. Recycle flow in a flame can be achieved by curved vanes, preferably at the periphery inducing a portion of such flame to curve outwardly and then possibly with the aid of, for example, a firebox wall back into a turbulent portion of the flame.

Useful methods for preparing the apparatus of this invention comprising metals, ceramic, and refractory materials include for example, use of a dry powder press, an isostatic press, extrustion, spin casting, and the like as would be recognized by a person of skill in the art.

BRIEF DESCRIPTION OF THE DRAWINGS

FIG. 1 is a cross-sectional side elevation view of a gas flame with a radiant screen.

FIG. 2 is a perspective view of an oil burner with a portion of the blast tube cut away in partial cross-section to reveal the interior of the blast tube.

FIG. 3 is a top elevation view of a firebox for a typical blast tube wherein various locations of the apparatus of FIGS. 8 and 9 are indicated by letters A-D.

FIG. 4 is an end view along line 4—4 of FIG. 3.

DETAILED DESCRIPTION OF THE INVENTION

Figure 5:
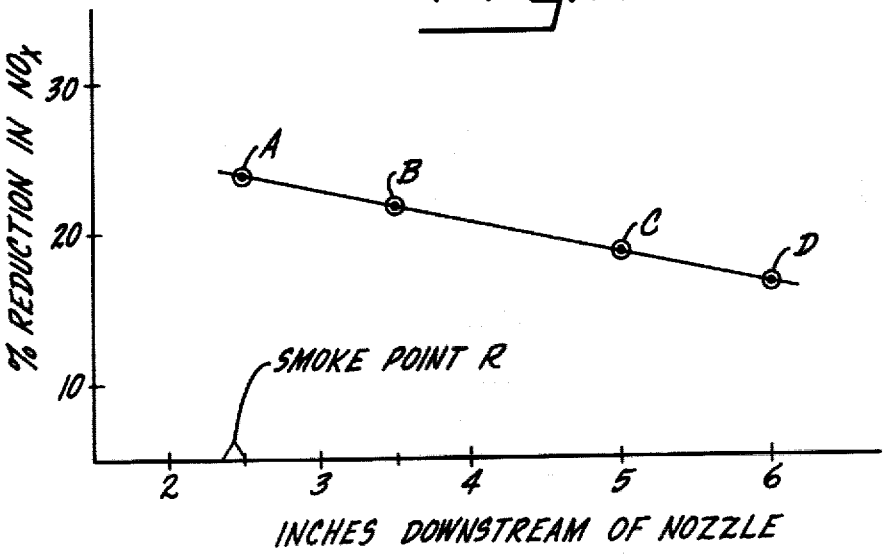
FIG. 5 is a graph of the relationship between the various locations indicated in FIG. 3 and the percent reduction in $NO_x$ found in the flame.

FIG. 1 discloses a prior art method for reducing $NO_x$ emissions in a flame by means of a radiant screen. The radiant screen 30 is located in the cone 32 of a typical gas flame. The flame comprising a cone 31 of unignited gas and a cone 32 of ignited gas, i.e. post emission or post ignition combustion products, is typical of flames produced in a gas burner jet and is substantially non-turbulent.

FIG. 2 discloses an oil burner 40 comprising a blast tube 42, retention head fins 44, nozzle 46, nozzle adapter 48, ignition system 50, oil line 52, mounting flange 54, fuel pump hose pressure line 56, oil pump 58, combustion air vane 60, combustion fan housing 62 and ignition transformer 64. The ignition system 50 is connected to ignition transformer 64. Oil pump 58 is connected by fuel pump pressure line 56 to oil line 52. Nozzle 46 is attached by means of nozzle adapter 48 to oil line 52. The ignition wires 49 of ignition system 50 are powered by transformer 64.

The oil burner of FIG. 2 functions as follows:

Oil or fuel is transferred under pressure by oil pump 58 through fuel pump pressure line 56 into oil line 52, and then through nozzle 46. Upon exiting nozzle 46 fuel is mixed with air introduced through an air vent. The opening of the air vent is controlled by combustion air vane 60. A rotating fan not shown, but contained in combustion fan housing 62 transfers air into blast tube 42. The air within blast tube 42 becomes mixed with fuel exiting nozzle 46 under the flow pattern induced by retention head fins 44. The mixture of fuel and air is ignited upon contact with ignition wires 49 which are powered by the ignition transformer 64. The flame exiting from the blast tube is introduced into a firebox such as disclosed in FIGS. 3 and 13. The flame from the blast tube is generally very turbulent due in part to the mixing action of the retention head fins 44.

FIG. 3 discloses a portion of blast tube 42 which is introducing a flame into a firebox 70. The firebox 70 of FIG. 3 comprises a sheet metal wall 72 with an insulative layer 74. Reference line R of FIG. 3 corresponds to the smoke plane. The smoke plane of a flame is defined by the leading edge or surface of the apparatus of this invention when the flame just begins to become smoky due to insertion of that apparatus in the flame. Down stream from the smoke plane, e.g. at positions A-D, the flame is substantially not smoky. The optimum location for the apparatus of this invention is as close to the smoke plane as possible without giving rise to a smoky flame. This is clear from the graph of FIG. 5. The location of the smoke plane for a blast tube will vary depending upon firebox radiation, air/fuel composition of a flame, and the flame to firebox configuration. Generally, the preferred location of the apparatus of this invention is down stream from the smoke plane by a distance, as measured from the smoke plane to the leading edge of the apparatus, of up to about sixty percent and preferably up to about forty percent of the free flame length. Free flame length is the distance from the ignition point of the flame, e.g. the point in a blast tube where the fuel is ignited by contact with a hot wire (see FIG. 2), to the maximum distance the flame would reach if a firebox wall opposite the flame did not interfere.

It has been found in the case of a blast tube having about an eleven inch flame that the percent reduction in $NO_x$ emissions decreases from about 23% to about 18% on moving from about ½ inch down stream from the smoke plane to about six inches down stream therefrom.

The flow pattern of combustion products exiting from blast tube 42 are indicated by dotted lines and arrows. The gases immediately down stream of blast tube 42 prior to contacting a device of this invention are turbulent to provide adequate air/fuel mixing and subsequent to contacting a device of this invention are significantly less turbulent.

The percent reduction in $NO_x$ versus the various locations of the apparatus of this invention is plotted in the graph of FIG. 5. The detailed experimental work involved in the data collected for the graph of FIG. 5 is discussed in EXAMPLE.

Figure 6:
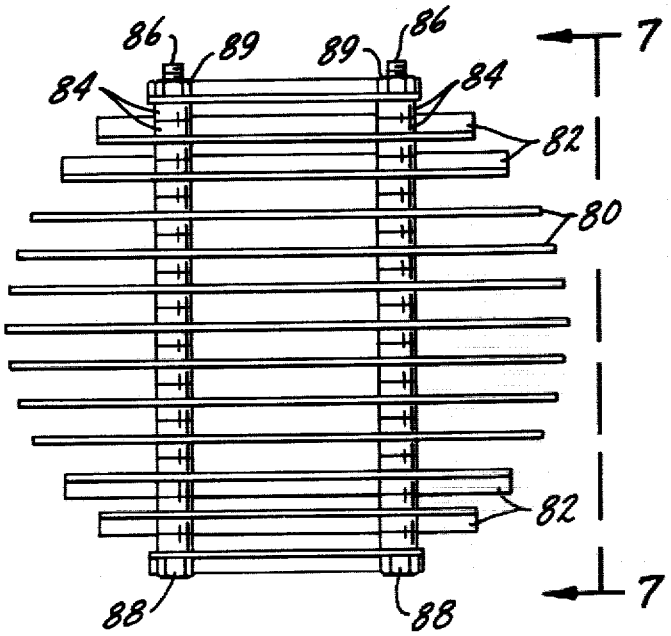
FIG. 6 is a side elevation view of a first embodiment of this invention.

FIG. 6 discloses a first embodiment of this invention comprising planar vanes 80, curved or bent vanes 82, spacers 84, and a bolt 86 with a bolt head 88 and a nut 89. Planar and bent vanes are made from ceramic materials capable of withstanding temperatures in the range of from about room temperature (72° F.) up to about 3500° F.

Figure 7:
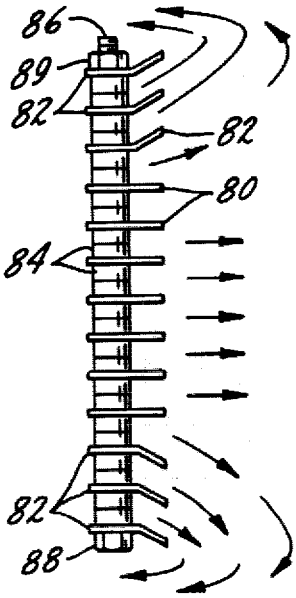
FIG. 7 is a view along line 7—7 of FIG. 6.

FIG. 7 is a view along line 7—7 of FIG. 6 and includes arrows showing the path followed by a flame which impinges on the first embodiment of this invention.

Figure 8:
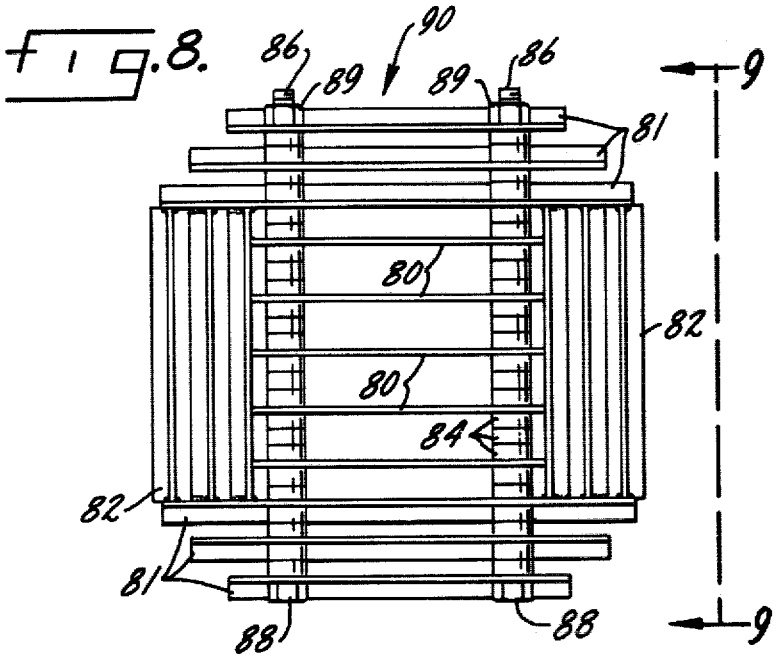
FIG. 8 is a side elevation view of a second embodiment of this invention.
Figure 9:
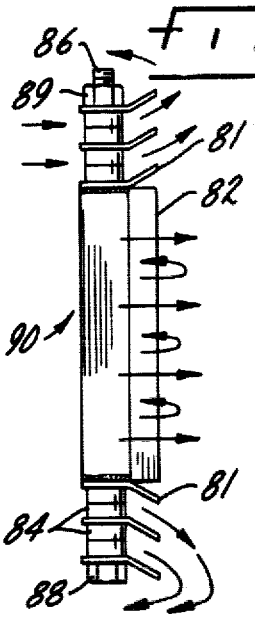
FIG. 9 is a view along line 9—9 of FIG. 8.

FIGS. 8 and 9 disclose a square array of vanes 90 comprising planar or unbent central vanes 80 and bent or curved peripheral vanes 81 and 82. Vanes 80 and 81 are connected together by bolts 86 and separated with spacers 84. Bent vanes 82 at the periphery are welded to innermost vanes 81. Bent vanes 81 and 82 induce the flow pattern shown in FIG. 9 upon a flame which impinges upon such apparatus. Spacers 84 maintain a desired distance between the vanes 80 and 81.

Figure 10:
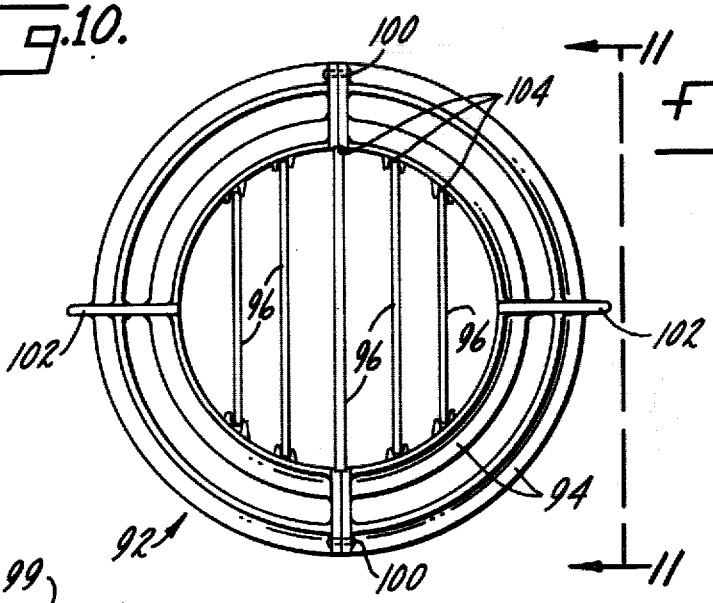
FIG. 10 is a side elevation view of a third embodiment of this invention.
Figure 11:
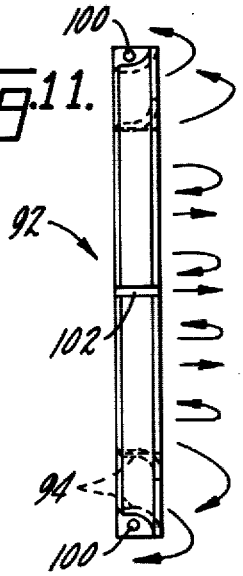
FIG. 11 is a view along line 11—11 of FIG. 10.

FIG. 10 discloses a circular array 92 of vanes comprising a plurality of circular and bent vanes 94 and central planar or unbent vanes 96. The peripheral bent circular vanes 94 are ceramic material molded in two halves having a leading edge which tapers to a point from one side as shown in FIG. 11. The halves are held together in use by ceramic pins 100. Mounting flanges 102 provides a means for positioning or supporting apparatus 92. Central planar vanes 96 slide into grooves 104. The bent circular peripheral vanes 94 cause the flow pattern shown in FIG. 11. The flow pattern of FIG. 11 comprises two laminar flow components, one a central component substantially unbent, and the second, a peripheral component with a flow pattern which is circular in cross section and flows back upon itself.

Figure 12:
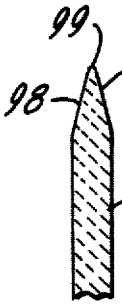
FIG. 12 is a cross-sectional end view along the length of a vane showing a leading edge.

FIG. 12 shows an alternative form for the leading edge of a vane of this invention. Vane 97 which can be used in place of vanes shown in FIGS. 6–11, provides a tapering 98 from two sides to a point 99.

Figure 13:
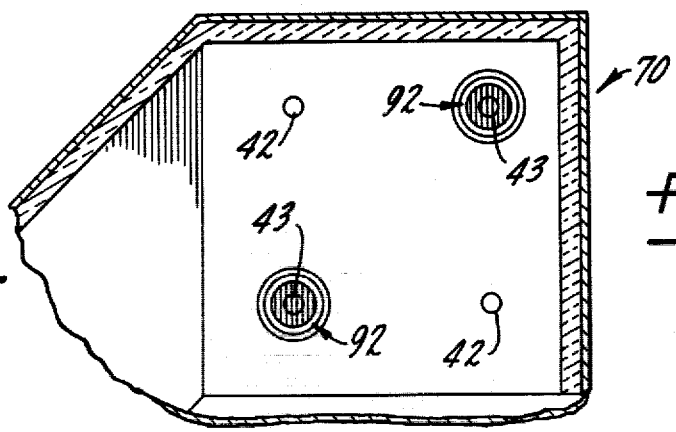
FIG. 13 is a perspective view of a firebox with a portion cut away to reveal the interior which has a plurality of blast tube openings and a plurality of devices of this invention disposed over some of the blast tube openings.

FIG. 13 is a firebox 70 which can be 10′×10′×6′ wherein several blast tubes 42 and 43 have been fitted to one wall. Blast tubes 43 have devices 92 spaced from the opening thereof.

Variations on the specific embodiments of the invention disclosed herein would be obvious to one of skill in the art based upon this specification. Such variations are intended to be within the scope of this invention.

EXAMPLE

This example relates to FIGS. 2–5, 8 and 9.

The results are consistent with the conclusion that reduced $NO_x$ emissions in post ignition products of a flame is related to the turbulence, all other factors being held constant, down stream of the smoke plane R and is a function of flame turbulence and combustion gas recycle present in the flame before and after the insertion of the apparatus of this invention. As the device moves further from the nozzle, i.e., more and more down stream, the percent reduction in $NO_x$ decreases.

The furnace assembly including both oil burner and firebox were a Peerless Upflow Warm-Air Furnace having a rating of 125,000 BTUs/hour measured at the hot air plenum or bonnet and was purchased from Ducane Heating Corporation, Totawa, New Jersey. The firebox dimensions were 11½ inches front to back having a radius of about 5¼ inches. The top was open.

The nozzle was a Delavan-Nominal 1.1 gal/hr 80 degree solid cone nozzle sold by Delavan Manufacturing Company, West DesMoines, Iowa.

A Beckett Model A flame retention head corresponding to retention fins 44 of FIG. 2 was used and purchased from R. W. Beckett Corporation, Elyria, Ohio.

A #2 fuel oil as defined in ASTM D-396 was passed at a rate of 0.929 gal/hr through the previously described apparatus.

The apparatus of FIGS. 8 and 9 was as follows. All vanes 80, 81, and 82 were made from Hastelloy X Metal with dimensions of 1/16 inch thick by 1 inch wide. The passageway spacings were between vanes 80 about ¾ of an inch; between vanes 81 about ⅝ of an inch; and between vanes 82 about ⅝ of an inch. Vanes 80 are about 3¾ inches long. Vanes 82 are welded with hastelloy rod and are about 4½ inches long. Peripheral vanes 81 are about 3¾ inches, 4¾ inches, and 5¾ inches long. Bolts and nuts are also Hastelloy X.

The apparatus of FIGS. 8 and 9 was suspended in the firebox of FIGS. 3 and 4 and moved to various locations A-D shown in FIG. 3. Line R of FIG. 3 indicates the location where incomplete combustion will occur if the apparatus were placed at R or nearer to blast tube 42.

Incomplete combustion was accompanied by a large evolution of smoke.

Corresponding to each location A-D, the percent reduction in $NO_x$ concentration was determined. It was found, see graph of FIG. 5, that the closer to smoke plane R, the greater the $NO_x$ reduction.

In another test it was found that for the above-described burner, that the width of the vanes of from $1\frac{1}{2}$ inches to 3 inches gave no measurable improvement, i.e., no increased reduction in $NO_x$, as the vanes became wider.

The embodiments of this invention in which an exclusive property or privilege is claimed are defined as follows:

1. A method for reducing $NO_x$ emissions in a turbulent flame having a temperature in the range of about 1700° F. to about 3500° F., said method comprising causing at least a portion of said flame; down stream of a smoke plane, wherein said smoke plane is defined by a location which the leading edge of an array of vanes which are stable both chemically and physically to high temperature and oxidizing environment of said flame and which have a thicknesses in the range of about 1/16 of an inch to about $\frac{1}{2}$ of an inch, widths in the range of about $\frac{1}{4}$ of an inch to about 3 inches, and the spaces therebetween in the range of about 3/16 of an inch to about 4 inches would have when the flame would just begin to become smoky due to insertion of said array in said flame, to flow in a non-turbulent pattern; whereby the amount of turbulence in the flow pattern of substantially only post ignition combustion products is reduced.

2. The method of claim 1, wherein at least 5% of the post ignition combustion products of said flame are non-turbulent and laminar.

3. The method of claim 2, wherein at least a portion of said flame which has been caused to flow in a non-turbulent pattern is at least in part recycled back into a portion of said flame which is turbulent.

4. A method for reducing $NO_x$ emissions in a turbulent flame having a temperature in the range of about 1700° F. to about 3500° F. and having a smoke plane, wherein said smoke plane is defined by a location which the leading edge of an array of vanes which are stable both chemically and physically to high temperature and oxidizing environment of said flame and which have thicknesses in the range of about 1/16 of an inch to about $\frac{1}{2}$ of an inch, widths in the range of about $\frac{1}{4}$ of an inch to about 3 inches, and the spaces therebetween in the range of about 3/16 of an inch to about 4 inches, would have when the flame would just begin to become smoky due to insertion of said array in said flame, said method comprising locating in said flame an apparatus comprising a flow modifying means for causing at least a portion of the post ignition products of said flame to flow in a non-turbulent pattern down stream from said smoke plane.

5. The method of claim 4, wherein the distance down stream from said smoke plane, as measured between said smoke plane and a leading edge of said apparatus is up to about sixty percent of the free flame length.

6. The method of claim 4, wherein said flow modifying means comprises an array of vanes adapted to cause a laminar flow of at least a portion of said flame.

7. The method of claim 6, wherein at least a portion of said vanes are shaped so as to cause a recycle flow of at least a portion of said flame, which has been induced to flow in a non-turbulent pattern, back into a portion of said flame which is turbulent.

8. The method of claim 4, wherein said flow modifying means comprises an array of spaced vanes capable of withstanding the environment of the flame and having a plurality of passageways therebetween wherein there is at least a first portion of said vanes which is substantially planar and wherein there is a second portion of said vanes which is shaped so as to cause a curved flow path to be followed by post ignition combustion products of said flame which comes into contact therewith.

9. The method of claim 8, wherein said first portion is spaced between at least two sections of said second portion.

10. The method of claim 4, wherein said flow modifying means comprises vanes having thicknesses in the range of about 1/16 of an inch to about $\frac{1}{2}$ of an inch, widths in the range of $\frac{1}{4}$ of an inch to about 3 inches, and the spaces therebetween are in the range of about 3/16 of an inch to about 4 inches.

* * * * *